US005396929A

United States Patent [19]

Rodriguez et al.

[11] Patent Number: 5,396,929

[45] Date of Patent: Mar. 14, 1995

[54] SANITARY FIXTURE

[75] Inventors: Jean-Jacques Rodriguez, Douvaine, France; Pierre Mamin, Crans Pres Celigny, Switzerland

[73] Assignee: Kugler, Fonderie et Robinetterie S.A., Geneva, Switzerland

[21] Appl. No.: 55,871

[22] Filed: May 4, 1993

[30] Foreign Application Priority Data

May 11, 1992 [CH] Switzerland ..... 1495/92

[51] Int. Cl.[6] ..... E03C 1/02

[52] U.S. Cl. ..... 137/801; 4/678

[58] Field of Search ..... 4/678; 137/801

[56] References Cited

U.S. PATENT DOCUMENTS

| | | | |
|---|---|---|---|
| 4,103,709 | 8/1978 | Fischer | 137/801 X |
| 5,014,749 | 5/1991 | Humpert et al. | 137/801 |
| 5,056,562 | 10/1991 | Pawelzik et al. | 137/801 |

FOREIGN PATENT DOCUMENTS

| | | | |
|---|---|---|---|
| 2331000 | 1/1975 | Germany | 137/801 |
| 3907892 | 9/1990 | Germany . | |
| 1277203 | 6/1972 | United Kingdom | 137/801 |
| 1437754 | 6/1976 | United Kingdom | 137/801 |

*Primary Examiner*—Gerald A. Michalsky
*Attorney, Agent, or Firm*—Young & Thompson

[57] ABSTRACT

A body (1) is provided, having at least one conduit designed to be connected to a hot and/or cold water supply, and also a water outflow conduit (4). This body (1) receives a mechanism (2) for controlling the water flow and/or the temperature of the outflowing water. It comprises a cladding (12) surrounding the lateral outer surface of the body (1) and including a sleeve (13) provided with an axial channel (14) ending by a part of a connector (19) designed for fastening a spout.

6 Claims, 2 Drawing Sheets

SANITARY FIXTURE

FIELD OF THE INVENTION

The present invention relates to is a sanitary fixture of the type comprising a body connected to a cold water and a hot water supply, as well as to a mixed water outlet, and provided with a mechanism for controlling the water flow actuated by an operating lever which can rotate and move vertically. Further, the body has a tube which surrounds the water outlet and which is provided at its free end with a bayonet type connector .which enables it to receive readily and removably all manner of spouts.

BACKGROUND OF THE INVENTION

Such a fixture is known from the document DE-A1-39 07 892 or from KUGLER's catalogue published May 1, 1988 and describing a sanitary fixture comprising a water outflow tube for mixed water in a threaded engagement with the body and surrounded by a decorative sleeve, the latter being tightly applied against the body of the fixture by means of a screw and bolt device pressing against the water outflow tube.

Such a sanitary fixture has significant drawbacks; the fixing of the sleeve is tedious, its shape is complicated on the one hand to adapt exactly to the body of the fixture and on the other hand because of the need to apply it with a tight fit on this body. Further, the joint between the body and the sleeve is always an area where dirt accumulates readily and which is difficult to clean.

The object of the present invention is to provide a sanitary fixture of this type, which avoids the above-mentioned drawbacks, reduces manufacturing costs and facilitates even further the assembling and maintenance operations.

SUMMARY OF THE INVENTION

The sanitary fixture according to the present invention, of the type indicated in the preamble, tends to obviate the above-mentioned drawbacks, it offers advantages in terms of manufacturing and assembling costs and it has the characteristic features set forth in claim 1.

The appended drawing illustrates schematically and by way or example three embodiments of the sanitary fixture according to the invention.

DETAILED DESCRIPTION OF THE INVENTION

Figure 1:
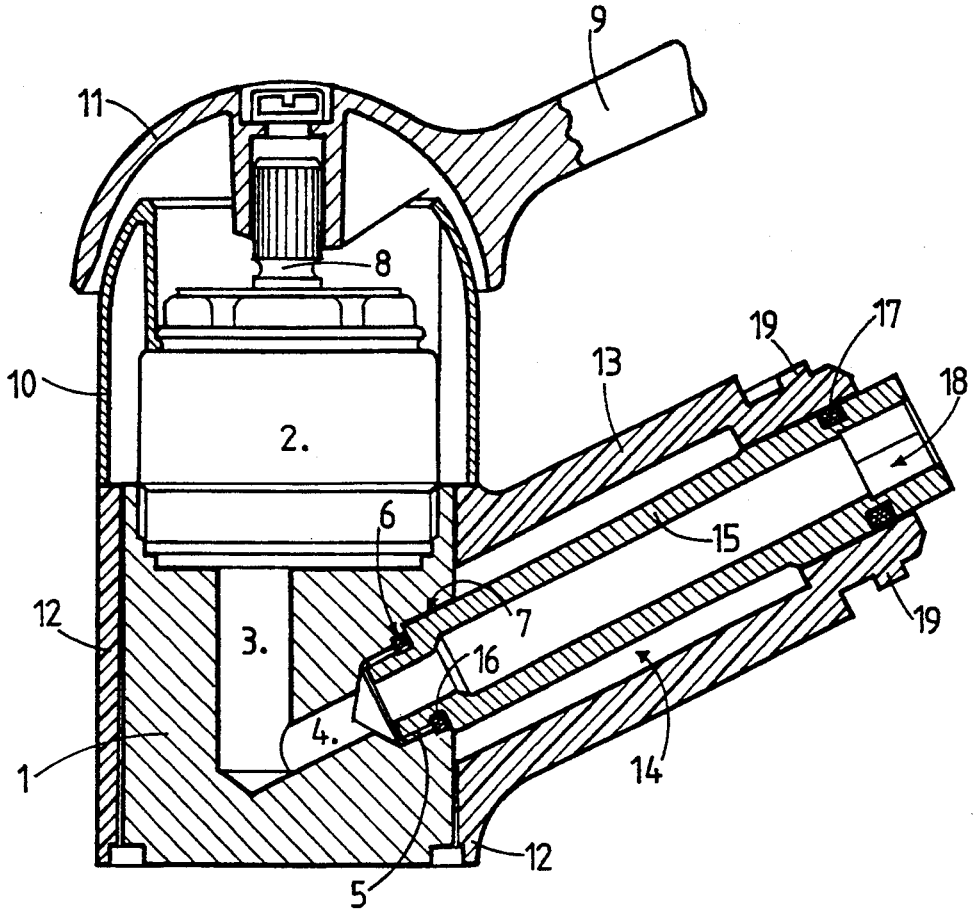
FIG. 1 is a cross-sectional view of a first embodiment of the sanitary fixture.

FIG. 1 illustrates the first embodiment of the sanitary fixture which is designed for mounting on a sink, a wash basin, a bath, a bidet, ere, generally on a horizontal surface, but which can also be mounted on a vertical or a sloped surface, for example of a wall.

This sanitary fixture includes a metallic body 1 which is generally produced by casting and which is provided with threaded bores opening on its lower surface for its mounting by means of screws, and with hot and cold water supply conduits designed to be connected in a conventional manner to the hot and cold water supply pipes.

The upper face of this body has a housing provided with a threading to make possible the fastening of a mixing mechanism 2, for example of the well-known type with a ceramic disc. The water inflow conduits of the body correspond to the water inlets of this mechanism, while the mixed water outlet of mechanism 2 corresponds to an axial outflow conduit 3 of the body in communication with a lateral outflow conduit 4. This lateral conduit 4 comprises a threaded section 5, a housing for an O-ring 6 and ends by a bore 7 opening on the side wall of the body 1.

The mechanism 2 comprises an operating member 8 protruding from its free upper surface, and on which is fastened a control lever 9, the rotation and the vertical motion of which make it possible to control both the volume of mixed water and its temperature. The mechanism is surrounded by a shell 10 which extends beneath the spherical part 11 of lever 9.

In this embodiment, the sanitary fixture further comprises a cladding having a hollow cylindrical section 12 and a sleeve 13 extending sideways. The hollow cylindrical section 12 has an internal diameter corresponding to the external diameter of the body and surrounds the latter. The sleeve 13 has an inner conduit 14, which, when the cladding is mounted on the body ready for use, opens on the bore 7 of the outflow conduit of the body and surrounds it. This cladding 12, 13 is generally formed by molding or injection molding from a synthetic material which can be colored throughout hour its mass, or a surface treatment can be applied, such as chromium plating.

One can already note here, that since the cladding 12, 13 is made as one part, the joint between the spout and the body is totally eliminated and no dirt can therefore accumulate in this area, which accordingly becomes easy to clean.

In addition, the metallic body 1 is no longer visible, since it is entirely surrounded by the cladding 12, 13, and its appearance is therefore not particularly important; accordingly, it can be used directly as east or machined, which eliminates all polishing and/or surface treatments and contributes to reducing production costs.

This sanitary fixture further comprises a water outflow tube 15, the threaded end of which is in a threaded engagement with the body 1, i.e. engaged with the threaded section 5 of the lateral outflow conduit 4. An O-ring 16 ensures the watertightness between this tube 15 and the body 1. This tube 15 extends inside the internal conduit 14 of the sleeve 13 and its extremity has a diameter corresponding to the internal diameter of this conduit 14 of the sleeve. An O-ring 17 ensures the watertightness between this outflow tube 15 and the sleeve 13. Owing to the O-rings 16 and 17, water cannot penetrate between the body 1 and the cladding 12, 13. The free end of the outflow tube 15 has a square opening 18 which makes it possible to rotate it, by using a square key, to ensure its threaded engagement with the body.

It should be noted here that the outflow tube 15 does not apply the sleeve 13 against the body 1, but merely ensures the angular positioning of the cladding 12, 13 with respect to the body.

Figure 4:
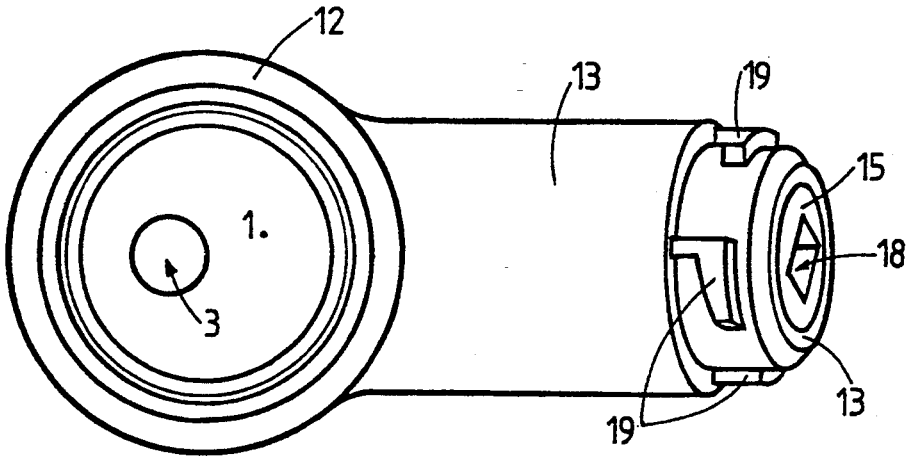
FIG. 4 is a top view of the body of one of the fixtures illustrated in FIGS. 1, 2 or 3.

As can be seen in FIGS. 1 and 4, the free end of the sleeve 13 of the cladding 12, 13 is provided with a part of a bayonet type connector 19 which makes it possible to fasten thereupon, removably and in a known manner, a spout with corresponding connector means and with means for ensuring watertightness between the spout and the sleeve 13.

In this first embodiment, it is still possible to replace only the cladding 12, 13 if the latter is damaged or if one wishes to change the colour. As to the body 1, it remains in place.

In the second embodiment, the body 1 of the fixture is east as one part including the outflow tube 20. The cladding 12, 13, made of plastic material, is molded on the surface of the body 1, 20. The free extremity of the sleeve 13 of this cladding includes, as previously, a part of a bayonet type connector for the ready fastening of a spout (not illustrated). In this embodiment, the outflow conduit 4 for the mixed water extends from the conduit 4 of body 1 through the outflow tube 20, which is integral with the body 1. As to the remainder of body 1, it is identical to that described in relation with the first embodiment.

In the two embodiments described previously, the cladding 12, 13 has merely a decorative purpose and does not have to withstand water pressure.

In the second embodiment also, the body can be produced directly by casting, without the need of polishing or surface treatment, which reduces manufacturing costs. Here also, since the cladding 12, 13 is made as one part, the risks of dirt accumulating at the joint between the spout and the body of current fixtures is thus eliminated.

Figure 2:
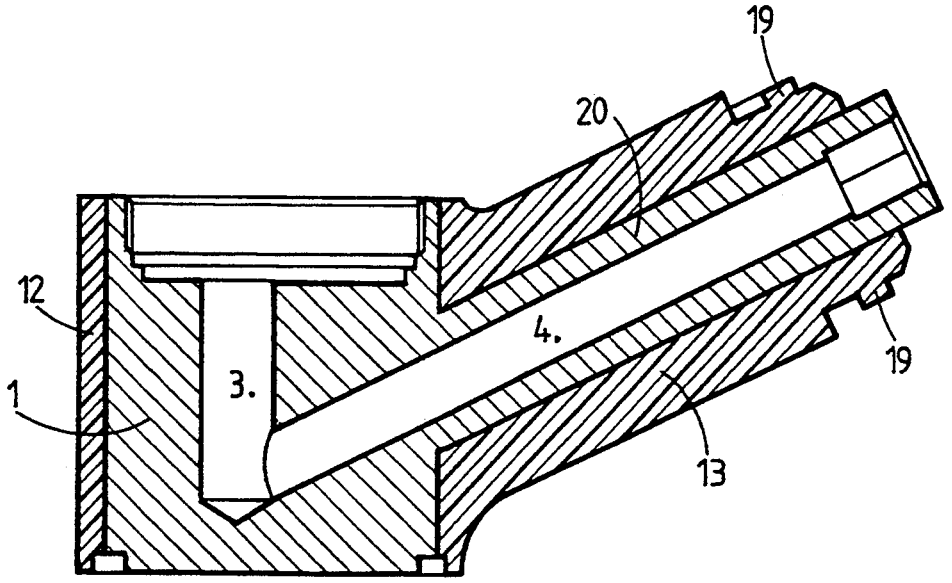
FIG. 2 is a cross-sectional view of the body of a second embodiment of the sanitary fixture.
Figure 3:
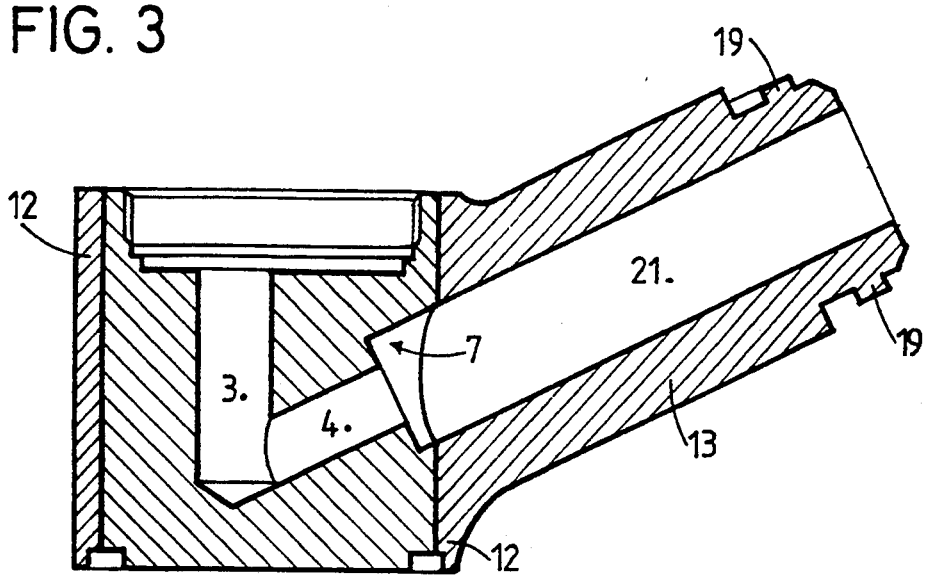
FIG. 3 is a cross-sectional view of the body of a third embodiment of the sanitary fixture.

In FIG. 3, as in FIG. 2, only the body 1 and the cladding 12, 13 of the fixture are shown, the remaining parts being identical to those described in relation to FIG. 1. In this third embodiment of the body 1 and of the cladding 12, 13 of the fixture, the body 1 has no outflow tube. Actually, this body has an axial outflow conduit 3 connected to a lateral outflow conduit 4, with the extremity 7 of the bore opening directly on the peripheral wall of the body 1, as in the first embodiment (FIG. 1), but without this conduit being threaded.

As in the second embodiment (FIG. 2), the cladding 12, 13 is molded on the surface of the body 1, to which of course a mold insert was added, the extremity of which was introduced tightly into the bore 7. The extremity of the molded sleeve 13 is also provided with a part of a bayonet type connector for the ready fastening of an interchangeable spout.

In this embodiment, the lateral outflow conduit 4 opens directly into the central channel 21 of the sleeve 13, so that the latter must be sufficiently strong to withstand water pressure.

This embodiment offers the advantage of a body which is very simple and therefore low in cost and avoids any metallic outflow tube, whether separate from the body 1 (FIG. 1) or integral therewith (FIG. 2).

In another version of this third embodiment, the cladding 12, 13 can be molded separately and not on the surface of the body, to be subsequently slipped on the body 1 without clearance or tightly fitted on it. Joints could be provided to ensure watertightness between the body 1 and the cladding 12, 13. This version would have the advantage of allowing an easy exchange of the cladding, should the latter be damaged or should one wish to change the colour of his fittings.

In all its embodiments, the sanitary fixture includes a sleeve provided with a part of a bayonet type connector which makes possible the use of interchangeable spouts, extensions, elbows, etc. Of course, the external shape of the sleeve and of the corresponding spout does not need to be circular in cross-section, and can be oval, polygonal, etc.

Also, it is clear that in other versions, any other method for coupling the spout and the sleeve of the sanitary fitting can be considered: threaded engagement, insertion, use of adhesive, etc.

For example, referring to FIG. 3, one could well imagine a version in which the passage 21 of the sleeve 13 would correspond to a passage of the body opening on its lower face and acting as a housing for the hose of a shower head. In this case, the axial outflow conduit 3 of body 1 opens also on the lower face of the body and can be connected to the extremity of the hose of the shower head.

In all cases, whether the cladding 12, 13 is slipped on the body 1, molded on its surface or applied in any other manner, nothing holds the sleeve of this cladding against the body 1, the outflow pipe 15, 20, when provided, acting only to hold the cladding in an axial and an angular position on the body.

In the embodiment described, the mechanism fastened on the body 1 is a mixing mechanism, but it could well be a simple water tap with an adjustable water flow of hot or cold water. In such a case, the body 1 has only one water inflow conduit and one outflow conduit.

We claim:

1. In a fixture for delivering water including a body having an outer lateral surface and at least one conduit designed for connection to a hot and cold water supply and a water outflow conduit; said body being adapted for receiving a mechanism for controlling the flow and temperature of outflowing water, actuated by an operating member, the improvement wherein the fixture comprises a cladding made as one part and surrounding the outer lateral surface of the body, said cladding including a sleeve provided with an axial channel; a water outflow pipe housed in the axial channel of the sleeve of the cladding, one end of which being engaged in a threading provided in a lateral outflow channel of the body, and said sleeve ending with connector means designed for fastening a spout.

2. A fixture according to claim 1, wherein the axial channel of the sleeve of the cladding is in communication with the outflow conduit of the body.

3. A fixture according to claim 2, further including sealing means for preventing water from leaking between the cladding and the body.

4. A fixture according to claim 1, wherein the cladding slides along the outer lateral surface of the body.

5. A fixture according to claim 4, wherein a joint is provided between the axial channel of the sleeve and the outflow pipe.

6. A fixture according to claim 1, wherein the connector means of the sleeve comprises a part of a bayonet type connector for removably fastening a spout.

* * * * *